US005841220A

United States Patent [19]

Ooms

[11] Patent Number: 5,841,220

[45] Date of Patent: Nov. 24, 1998

[54] LOW-PRESSURE MERCURY DISCHARGE LAMP

[75] Inventor: Pieter C. Ooms, Terneuzen, Netherlands

[73] Assignee: U.S. Philips Corporation, New York, N.Y.

[21] Appl. No.: 680,097

[22] Filed: Jul. 15, 1996

[30] Foreign Application Priority Data

Jul. 21, 1995 [EP] European Pat. Off. ..... 95202013

[51] Int. Cl.[6] ..... H01J 61/28

[52] U.S. Cl. ..... 313/565; 313/563; 313/490

[58] Field of Search ..... 313/563, 490, 313/565

[56] References Cited

U.S. PATENT DOCUMENTS 3,562,571 2/1971 Evans et al. ..... 313/109

4,105,910 8/1978 Evans ..... 313/490

5,204,584 4/1993 Ikeda et al. ..... 313/565

*Primary Examiner*—Ashok Patel

*Assistant Examiner*—Matthew J. Gerike

*Attorney, Agent, or Firm*—Edward Blocker

[57] ABSTRACT

A low-pressure mercury discharge lamp is provided with a tubular discharge vessel (10) with end portions (11, 11') having an ionizable filling comprising mercury and rare gas. An electrode (20, 20') is arranged in the discharge vessel at each end portion and is fastened to current supply conductors (30A, 30B; 30A', 30B') which are passed through the end portion to the outside of the discharge vessel. At least one current supply conductor is covered with an amalgam in a zone (35A, 35B) which is at a distance from the end portion (11) via a path along the current supply conductor (30A, 30B). The amalgam can be comparatively easily applied in the lamp.

17 Claims, 3 Drawing Sheets

LOW-PRESSURE MERCURY DISCHARGE LAMP

BACKGROUND OF THE INVENTION

This invention relates to a low-pressure mercury discharge lamp provided with a tubular discharge vessel having end portions and containing an ionizable filling which comprises mercury and a rare gas, an electrode being arranged at an end portion in the discharge vessel and being fastened to current supply conductors which issue through said end portion to outside the discharge vessel, while at least one current supply conductor supports an amalgam.

Such a lamp is known from U.S. Pat. No. 5,204,584. The current supply conductor in the known lamp supports an amalgam which is provided on a metal plate which is fastened to the current supply conductor. This amalgam acts as an auxiliary amalgam whose function it is to accelerate the run-up, i.e. the speed with which the lamp approaches its rated lumen output after switching-on. This is achieved in that the amalgam releases the mercury bound thereto owing to heat originating from the electrode after switching-on, thus causing the mercury vapor pressure in the discharge vessel to rise quickly up to a value desired for nominal operation. It is a disadvantage that the plate involves extra cost owing to its manufacture, storage, transport, and assembly with other lamp components.

SUMMARY OF THE INVENTION

It is an object of the invention to provide a lamp of the kind described in the opening paragraph whose manufacture is cheaper and which nevertheless reaches its rated lumen output comparatively quickly.

According to the invention, a lamp of the kind described in the opening paragraph is for this purpose characterized in that the amalgam covers a zone of the current supply conductor which is removed from said end portion by a path along the current supply conductor.

The amalgam is readily applied in that the zone of the current supply conductor to be covered is passed through a metal bath, during which metal from the bath wets said zone. The metal bath comprises an amalgam or an amalgam former, i.e. a metal such as indium which forms an amalgam, or an amalgam-forming alloy, for example of lead and tin. In the latter case, the amalgam may form itself on the current supply conductor, for example, together with mercury vapor from the discharge space of the discharge vessel after the lamp has been given its filling. Wetting of the zone to be covered may be promoted through the use of a flux. A zone to be covered may first be provided with a layer of a different metal, if so desired, for promoting the adhesion of the covering of amalgam or amalgam former to the current supply conductor. Alternatively, the coating may be provided, for example, electrolytically.

The quantity of amalgam on the relevant zone may be readily chosen by those skilled in the art as a function of the thickness of the current supply conductor and the length of the zone.

The temperature which the amalgam assumes during lamp operation may be chosen through the choice of the position occupied by the zone relative to the electrode.

It is noted that U.S. Pat. No. 4,105,910 discloses a low-pressure mercury discharge lamp of which a zone of the end portion of the discharge vessel is coated with amalgam. The coating also extends over a zone of a current supply conductor adjoining the end portion. The amalgam forms a point of application for the discharge arc at the end of lamp life. The end portion of the discharge vessel is strongly heated then so that it melts and air can flow into the discharge vessel, thus interrupting lamp operation.

In the lamp according to the invention, the zone of the current supply conductor covered with amalgam may extend, for example, beyond the electrode into the space between the electrodes, but alternatively the current supply conductor may be so bent that the zone lies between the end of the discharge vessel and the location where the current supply conductor enters the discharge space.

The location of the covered zone on the current supply conductor is dependent on the depth over which the current supply conductor was dipped in the electrolytic bath or metal bath and on the shape which the current supply conductor had during dipping. In a favorable embodiment of the lamp according to the invention, the zone extends away from a free end of the current supply conductor. This embodiment is comparatively easy to realize.

In an advantageous embodiment of the lamp according to the invention, the zones covered with amalgam are bent for example into a spiral or meander shape, so that a comparatively large surface area is available for the amalgam within a comparatively small volume.

The current supply conductors are made of, for example, Fe, Ni, FeNi, or CrNiFe.

A higher run-up speed is achieved already when the lamp carries an amalgam on one of the end portions. With a comparatively long discharge vessel, for example longer than 40 cm, it takes a comparatively long period before the released mercury vapor has spread through the discharge space enclosed by the discharge vessel. It is favorable in that case for the discharge vessel to be provided with amalgam at both end portions.

The lamp current passes mainly through one of the current supply conductors, called live current supply conductor hereinafter, in the usual lamp supply units. Since the discharge arc applies itself to a location of the electrode which adjoins this current supply conductor, the live current supply conductor assumes a comparatively high temperature. It is favorable when this current supply conductor is provided with amalgam.

It is not always certain beforehand, however, which current supply conductor will be the live current supply conductor. This is the case, for example, when the lamp and its supply are mutually detachable and can be coupled in different ways. It is favorable in that case that both current supply conductors are provided with amalgam.

Besides one or several amalgams acting as auxiliary amalgam(s), the lamp may in addition have one or several amalgams acting as main amalgam(s), i.e. amalgams which define the mercury vapor pressure in the discharge space during nominal operation. A main amalgam is arranged, for example, in an exhaust tube of the discharge vessel. Alternatively, a main amalgam may be absent. The mercury vapor pressure in the discharge vessel is then a function of the mercury vapor pressure belonging to the coldest spot of the discharge vessel.

An attractive embodiment of the low-pressure mercury discharge lamp according to the invention is characterized in that the electrode is clamped in a bend of a respective current supply conductor at both ends. The electrode is, for example, a tungsten coil which is coated with an electron-emitting substance. Alternatively, the electrode is, for example, a sintered body of, for example, tungsten, oxides of alkaline earths, and oxides of rare earths (Sc, Y, La and the lanthanides). Such an electrode may be fastened to the current supply conductors by welding.

It is favorable when the amalgam-covered zone of the current supply conductor is at a distance from the bend of the current supply conductor. Amalgam is prevented thereby from polluting the electrode. Amalgam on the electrode may hamper the electron-emitting effect. In addition, an amalgam can spread further through the discharge vessel from the electrode. This generally has an unfavorable influence on the mercury vapor pressure.

In an attractive embodiment, the amalgam-covered zones of the current supply conductors occupy mutually differing positions relative to the electrode. This contributes to the effect that the auxiliary amalgams thus formed evolve mercury during different time intervals after switching-on of the lamp. It can be counteracted thereby that an excess or shortage of mercury arises temporarily after switching-on.

Instead of coating the current supply conductors before they are fastened to an end portion of the discharge vessel, it is also possible to coat the current supply conductors after assembling with the end portion. If one of the current supply conductors need not be provided with a coating of amalgam or amalgam former, the end portion may pass the metal bath or electrolytic bath at an angle, so that only one of the current supply conductors is immersed. If so desired, the current supply conductors may be temporarily bent apart during this immersion procedure.

The covering may be provided on a current supply conductor after the electrode has been fastened thereto. The current supply conductor may be bent so far during this that it projects beyond the electrode relative to the end portion. After the coating has been provided, the current supply conductor may be bent back or bent further so that it points to the end portion again.

BRIEF DESCRIPTION OF THE DRAWINGS

These and other aspects of the invention will be explained in more detail with reference to the accompanying drawing, in which.

DESCRIPTION OF THE PREFERRED EMBODIMENTS

Figure 1:
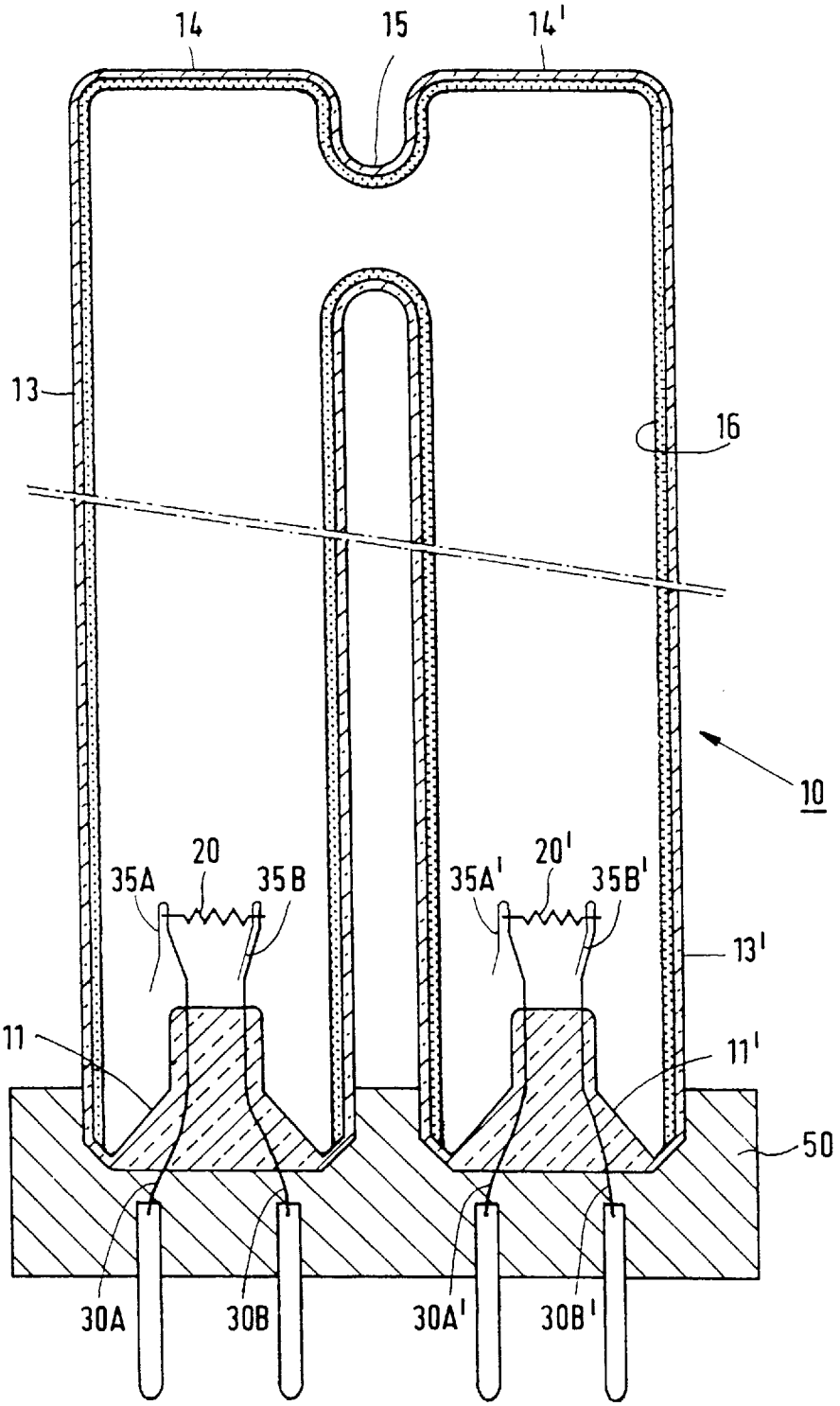
FIG. 1 shows a first embodiment of the low-pressure mercury discharge lamp according to the invention.

FIG. 1 shows a low-pressure mercury discharge lamp provided with a tubular discharge vessel 10 with end portions 11, 11' which contains an ionizable filling comprising mercury and rare gas. The discharge vessel 10 in the embodiment shown has two tube parts 13, 13' each with an end portion 11, 11'. The end portions 11, 11' are jointly fixed in a lamp cap. The tube parts 13, 13' are in communication through a channel 15 at tube ends 14, 14' lying opposite the lamp cap 50. Alternatively, the discharge vessel may be constructed, for example, as a single straight or bent tube, for example a tube bent into hook shape. The discharge vessel 10 supports a luminescent layer 16. An electrode 20, 20' is positioned at each end portion 11, 11' in the discharge vessel. Alternatively, an external electrode may be arranged at an end portion of the discharge vessel so as to provide a capacitive coupling to a lamp supply. Current supply conductors 30A, 30B; 30A', 30B' issue from the electrodes 20, 20' through the end portion 11, 11' to outside the discharge vessel 10. At least one current supply conductor 30A supports an amalgam. In the present embodiment, the current supply conductor 30B also supports an amalgam.

The amalgam, here mercury-indium, covers a zone 35A of the current supply conductor 30A, which zone is removed from the end portion 11 via a path along the current supply conductor 30A. The zones 35A, 35B here each extend away from a free end 34A, 34B (see also FIG. 2 where the zones 35A and 35B are shown darkened relative to the remainder of the current supply conductors. The discharge vessel 10 is shown in broken lines). The zones 35A, 35B each have a length of 5 mm and a coating of 10 $\mu$m thickness. The quantity of indium in each zone is 0.6 mg. The current supply conductors 30A, 30B each comprise a first segment 31A, 31B of iron wire with a thickness of 0.5 mm, a second segment 32A, 32B of NiFeCuMn wire of 0.35 mm thickness, and a third segment 33A, 33B of CuSn wire of 0.5 mm thickness, which wires extend substantially inside the discharge vessel 10, in the wall 12 of the end portion 11 of the discharge vessel 10, and outside the discharge vessel 10, respectively (see FIG. 2, where the second 32A, 32B and the third segments 33A, 33B are shown in broken lines). The lamp has a similar construction at the end portion 11'.

Figure 2:
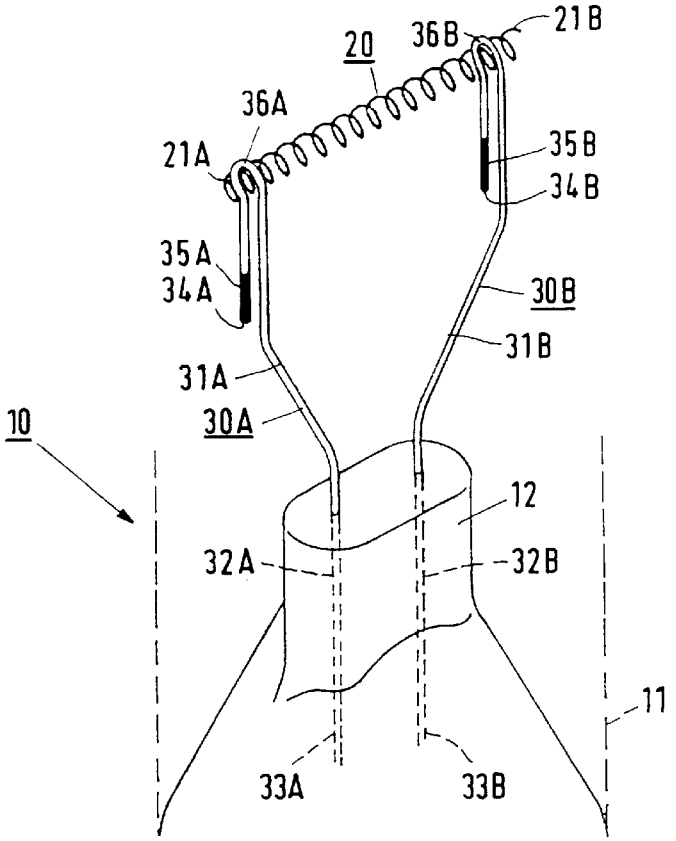
FIG. 2 is a perspective view of a detail of the lamp of FIG. 1.

In the embodiment of FIGS. 1 and 2, the current supply conductors 30A, 30B; 30A', 30B' each have such a zone 35A, 35B coated with auxiliary amalgam at the end portion 11, 11' of the discharge vessel 10. The construction of the end portions is not shown in detail in FIG. 1 for reasons of clarity.

The electrode 20, 20' is a coil of tungsten coated with an electron-emitting substance, here a mixture of oxides of barium, calcium, and strontium. The coil 20, 20' is clamped at either end 21A, 21B in a bend 36A, 36B of a respective current supply conductor 30A, 30B. The bend 36A, 36B encloses an angle of approximately 180°.

The zone 35A, 35B covered with auxiliary amalgam is a few millimeters, here 5 mm, away from the bend 36A, 36B.

During lamp manufacture, the end portions 11, 11' of the discharge vessel 10 may be passed along a metal bath after being assembled with the current supply conductors 30A, 30B; 30A', 30B', such that the current supply conductors are immersed in the bath over the length of the zone to be covered. Alternatively, the covering of amalgam or amalgam former on the current supply conductors may be provided before they are assembled together with the end portion of the lamp. The electrode may be fastened to the current supply conductors in the usual manner in that the current supply conductors are each bent around an end of the electrode. The end portions of the discharge vessel may subsequently be fused together with the tubular portion of the discharge vessel, whereupon the discharge vessel is flushed, cleaned and provided with its filling through an exhaust tube (not shown). If the current supply conductors are covered by an amalgam former, the latter may form an amalgam with mercury from the filling.

Figure 3:
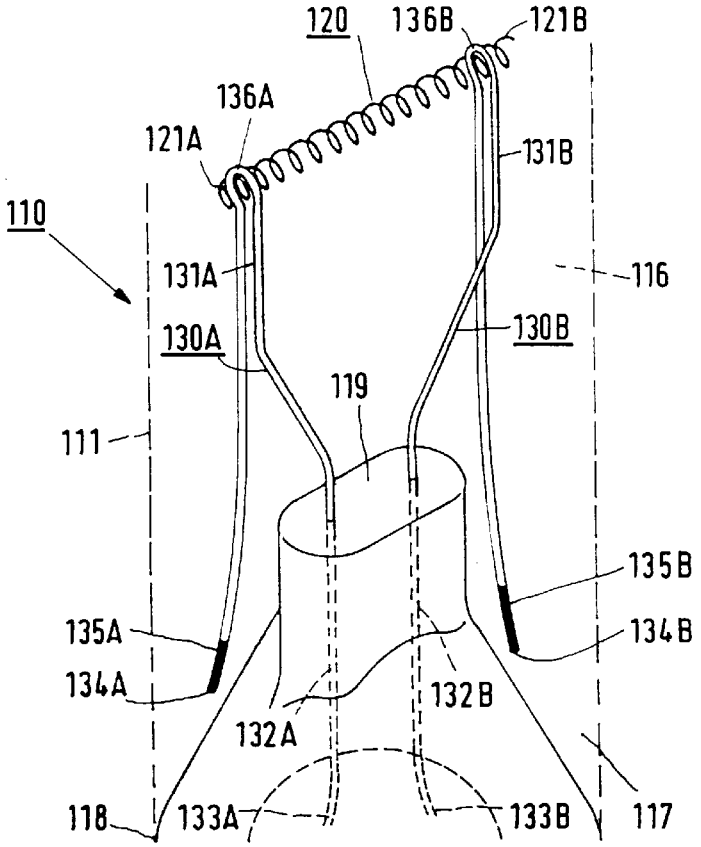
FIGS. 3, 4 and 5 show in perspective view a detail of a second, third, and fourth embodiment of the lamp according to the invention, respectively.

In FIG. 3, parts corresponding to those of FIG. 2 have reference numerals which are 100 higher. In the embodiment of FIG. 3, the amalgam-covered zones 135A, 135B of the current supply conductors 130A, 130B are present in a portion 117 of the discharge space 116 between the end 118 of the discharge vessel and the place 119 where the current supply conductors 130A, 130B enter the discharge space 116.

Figure 4:
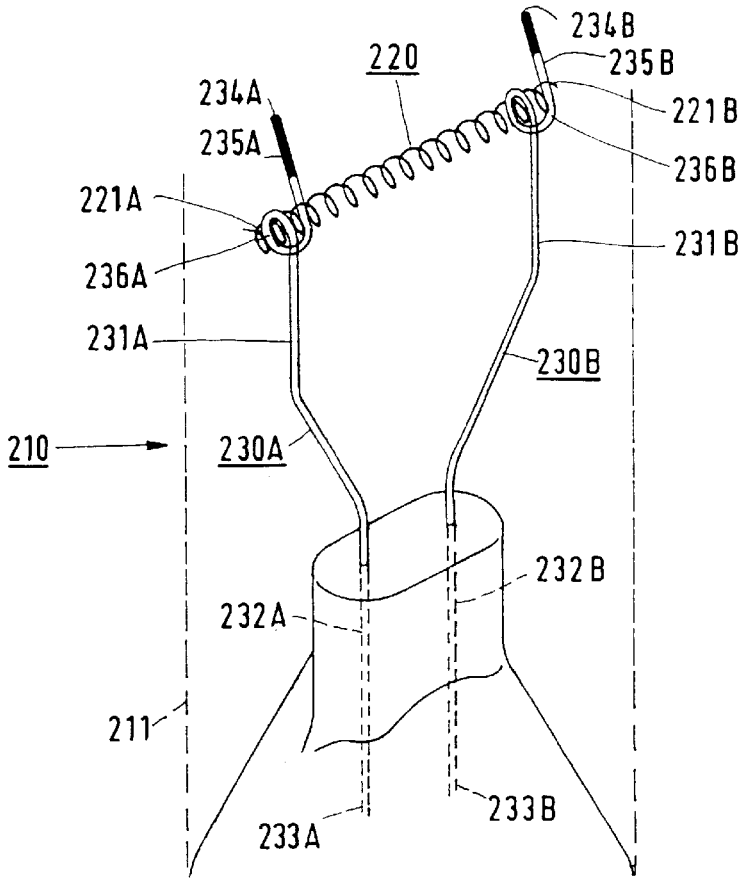

In FIG. 4, parts corresponding to those of FIG. 2 have reference numerals which are 200 higher. In the embodiment shown in FIG. 4, the current supply conductors 230A, 230B are bent through an angle of approximately 360° around the ends 221A, 221B of the electrode 220 so that the amalgam-covered zones 235A, 235B extend in front of the electrode 220. The amalgam on the zones 235A, 235B may have been provided, for example, after the electrode had been fastened to the current supply conductors.

Figure 5:
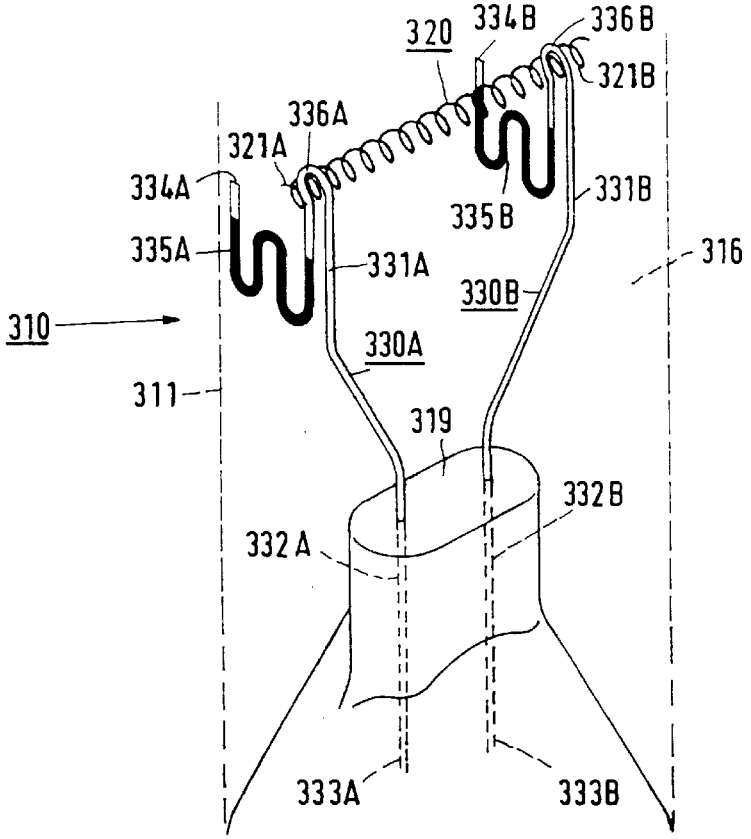

Parts in FIG. 5 corresponding to those of FIG. 2 have reference numerals which are 300 higher. In the embodiment shown in FIG. 5, the zones 335A, 335B are bent into a meander shape so that they have a comparatively large surface area within a comparatively small volume. The free ends 334A, 334B of the current supply conductors 330A, 330B are free from amalgam.

I claim:

1. A low-pressure mercury discharge lamp comprising a tubular discharge vessel having end portions and containing an ionizable filling which comprises mercury and a rare gas, an electrode arranged at an end portion in the discharge vessel, current supply conductors which issue through said end portion to outside of the discharge vessel, the electrode being fastened to the current supply conductors, and an amalgam supported by at least one current supply conductor, the amalgam covering a zone of said at least one current supply conductor which is removed from said end portion by a path along the current supply conductor.

2. A low-pressure mercury discharge lamp as claimed in claim 1, wherein the zone extends at a free end of the respective current supply conductor.

3. A low-pressure mercury discharge lamp as claimed in claim 1, wherein the current supply conductors (30A, 30B) each have an amalgam-covered zone at at least one end portion of the discharge vessel.

4. A low-pressure mercury discharge lamp as claimed in claim 1, wherein each end of the electrode is clamped in a bend of a respective current supply conductor.

5. A low-pressure mercury discharge lamp as claimed in claim 4, wherein the amalgam-covered zone is located at a distance from the bend of the respective current supply conductor.

6. A low-pressure mercury discharge lamp as claimed in claim 4, wherein the amalgam-covered zone extends along a non-linear path.

7. A low-pressure mercury discharge lamp as claimed in claim 2, wherein each end of the electrode is clamped in a bend of a respective current supply conductor.

8. A low-pressure mercury discharge lamp as claimed in claim 2, wherein the amalgam-covered zone extends along a non-linear path.

9. A low-pressure mercury discharge lamp as claimed in claim 5, wherein the amalgam-covered zone extends along a non-linear path.

10. An electric discharge lamp comprising:

a discharge vessel containing an ionizable medium and having first and second sealed end portions, at least one electrode located within the discharge vessel at one of said end portions, first and second current supply conductors within the discharge vessel and which extend through said one end portion to the outside of the discharge vessel, said electrode being connected to said current supply conductors, and an amalgam covering a zone of at least one current supply conductor which is remote from said one end portion by a path extending along the current supply conductor.

11. The electric discharge lamp as claimed in claim 10 wherein said one electrode is fastened to said first and second current supply conductors at an intermediate point thereof such that each current supply conductor has a free end, and wherein at least a part of the free end of at least one of said current supply conductors comprises said zone coated with an amalgam material.

12. The electric discharge lamp as claimed in claim 11 wherein said free ends of the first and second current supply conductors each extend in a direction approximately parallel to respective portions of the respective current supply conductor that extend between the one electrode and the one sealed end portion of the discharge vessel.

13. The electric discharge lamp as claimed in claim 11 wherein said amalgam coated zone covers an end part of the free end of the current supply conductor such that a further part of said free end extending up to its respective electrode is free of amalgam material.

14. The electric discharge lamp as claimed in claim 11 wherein said amalgam coated part of the free end of said one current supply conductor has a serpentine or spiral configuration.

15. The electric discharge lamp as claimed in claim 10 wherein said amalgam coated zone of the current supply conductor is spaced at a distance from said one electrode.

16. The electric discharge lamp as claimed in claim 10 wherein each sealed end portion includes a respective electrode and respective first and second current supply conductors with each conductor having an amalgam coated zone, and wherein at least two of said amalgam coated zones occupy mutually different positions relative to the electrodes.

17. The electric discharge lamp as claimed in claim 10 wherein the one current supply conductor has a non-linear configuration.

* * * * *